US007823546B2

(12) United States Patent
Carlson et al.

(10) Patent No.: US 7,823,546 B2
(45) Date of Patent: Nov. 2, 2010

(54) SUPER CHARGED ENGINE

(75) Inventors: Cliff Carlson, Fenton, MI (US); Steven F. Lowe, White Lake, MI (US)

(73) Assignee: High Density Powertrain, Inc., Waterford, MI (US)

( * ) Notice: Subject to any disclaimer, the term of this patent is extended or adjusted under 35 U.S.C. 154(b) by 264 days.

(21) Appl. No.: 12/130,956

(22) Filed: May 30, 2008

(65) Prior Publication Data

US 2008/0302343 A1 Dec. 11, 2008

Related U.S. Application Data

(60) Provisional application No. 60/940,780, filed on May 30, 2007.

(51) Int. Cl.
*F02B 75/18* (2006.01)

(52) U.S. Cl. ..... 123/56.3; 123/56.6; 123/245

(58) Field of Classification Search ..... 123/241–249, 123/56.1–60.1
See application file for complete search history.

(56) References Cited

U.S. PATENT DOCUMENTS

| | | | | | |
|---|---|---|---|---|---|
| 1,476,275 | A | * | 12/1923 | Wishon | 123/56.6 |
| 1,978,194 | A | * | 10/1934 | Gray | 123/41.74 |
| 2,236,738 | A | * | 4/1941 | Swensen | 74/60 |
| 2,354,620 | A | * | 7/1944 | Smith | 60/607 |
| 2,368,933 | A | * | 2/1945 | Lindeman, Jr. | 74/60 |
| 3,528,394 | A | * | 9/1970 | Cummins | 123/51 A |
| 3,528,396 | A | * | 9/1970 | Cummins | 123/265 |
| 4,145,163 | A | | 3/1979 | Fogelberg et al. | |
| 4,285,303 | A | * | 8/1981 | Leach | 123/51 BA |
| 4,489,682 | A | * | 12/1984 | Kenny | 123/51 B |
| 4,510,894 | A | * | 4/1985 | Williams | 123/48 R |
| 4,869,212 | A | * | 9/1989 | Sverdlin | 123/51 B |
| 6,279,520 | B1 | * | 8/2001 | Lowi, Jr. | 123/56.1 |
| 6,435,145 | B1 | | 8/2002 | Said et al. | |
| 6,460,450 | B1 | * | 10/2002 | Sanderson et al. | 92/71 |
| 6,725,815 | B2 | * | 4/2004 | Cannata | 123/56.1 |
| 7,156,056 | B2 | * | 1/2007 | Lemke et al. | 123/41.35 |
| 7,509,930 | B2 | * | 3/2009 | duPont | 123/56.6 |
| 2004/0007126 | A1 | | 1/2004 | Parsch | |
| 2005/0221937 | A1 | | 10/2005 | Vladimirovich et al. | |
| 2005/0276699 | A1 | | 12/2005 | Kuhn | |

* cited by examiner

*Primary Examiner*—Thomas Denion
*Assistant Examiner*—Douglas J. Duff
(74) *Attorney, Agent, or Firm*—Gifford, Krass, Sprinkle, Anderson & Citkowski, P.C.

(57) ABSTRACT

An engine with an output shaft extending through the engine block and generally parallel to the piston, the engine includes a boost piston cylinder integral to the cylinder, and a boost piston for producing compressed air so as to supercharge the engine. The engine further includes an energy translation mechanism translating linear movement into rotary movement, an energy translation mechanism for reducing the side force that the piston exerts against the inner wall of the combustion chamber, an energy transforming member working in concert with an engine torque absorbing/motion control torque reaction device to eliminate the lemniscate motion from being translated to the piston and to absorb all engine torque to case ground through a rolling element bearing, and a port time control system having a shaft phaser to adjust the phase of the pistons or the position of the air control valve.

1 Claim, 6 Drawing Sheets

SUPER CHARGED ENGINE

CROSS REFERENCE TO RELATED APPLICATION

This application claims the benefit of U.S. provisional patent application Ser. No. 60/940,780 filed May 30, 2007.

FIELD OF THE INVENTION

The present invention relates to an engine having a means for supercharging the engine housed within the engine block, an air control valve synchronized with the rotation of the output shaft so as to timely deliver compressed air into the combustion chamber, and means for reducing the amount of side friction the pistons exert on the inner walls of the combustion chamber as a result of the translation of linear movement into output shaft rotation.

BACKGROUND OF THE INVENTION

Barrel engines have a unique advantage over crankshaft engines in that they are more compact. This is mainly because barrel engines unlike crankshaft engines comprise pistons that work in parallel to an output shaft as opposed to perpendicular. However, an energy translation mechanism such as a wobble plate, swash plate, cam, or other means is required to translate the linear motion of the pistons into rotary motion about the output shaft. These energy translating mechanisms translate the upstroke and downstroke action of a piston into rotary moment about an output shaft by placing a torque onto the output shaft.

Currently, barrel engines, as well as crankshaft engines, have reduced efficiency because piston force is dissipated in various forms such as high sliding friction caused by the torque forcing the piston into contact with the inner walls of the combustion chamber. In addition there is a minor amount of friction in the barrel engine due to the translation of the linear motion of the pistons into rotary motion of the output shaft creates a lemniscate motion. This motion is translated along the length of the piston causing the piston to act against the inner wall of the cylinder liner which in turn reduces the force of the power stroke. Accordingly, such an engine may include devices to increase engine power density, such as an air control valve. Air control valves collect compressed gas and direct the compressed gas to a combustion chamber, thereby creating more force as the fuel is introduced into the chamber and ignited. Such devices are currently separate from the barrel engine and thus the desirable compact feature of the barrel engine is diminished. Furthermore, current air control valves operate off an auxiliary output shaft thus further decreasing engine efficiency as energy is transferred from the primary output shaft to the auxiliary output shaft.

Barrel engines are also susceptible to wear, particularly at the point where the piston acts on the energy translation mechanism because of the lemniscate motion. The use of a sliding ball socket joint is currently used to mitigate wear on the energy translating mechanism. However such joint assemblies have limited the degree of movement of the energy translation mechanism about the output shaft to approximately 20 degrees, thus limiting engine stroke length. Another disadvantage of current barrel engines is that the fuel injection is located on the side of the cylinder, thus unlike crankshaft engines where the fuel is injected into the length of the cylinder, fuel in a barrel engine is injected into the side making combustion control more difficult.

In general the efficiency and power output of an engine is increased by controlling the supercharging of the engine (meaning the addition of compressed air into the combustion chamber), injecting fuel at a degree to achieve optimal combustion control, and enabling longer engine strokes relative to bore diameter. Accordingly, it is desirable to have an engine equipped with supercharging capabilities, optimal fuel injection, and long engine strokes relative to bore diameter.

SUMMARY OF THE INVENTION AND ADVANTAGES

An engine having an output shaft extending through the engine block. The output shaft is generally parallel to the cylinder. The engine includes a boost piston cylinder integral to the cylinder, and a piston having a boost piston integrally attached thereto. The boost piston provides compressed air for later introduction into the combustion chamber so as to supercharge the engine. The engine further includes an energy translation mechanism for translating the linear movement of the piston into rotary movement of the output shaft. The energy translation mechanism is attached to the piston and the output shaft. The energy translation mechanism includes a ring shaped body and an arm extending from the ring shaped body and slidably attached to the piston. Thus as the piston moves back and forth in its cyclic operation, the arm engages a portion of the ring shaped body thereby forcing a portion of the ring shaped body onto a portion of the output shaft generating torque which turns the output shaft. The energy translation mechanism includes a rotary joint assembly for reducing the side force that the piston exerts against the inner wall of the combustion chamber as a result of the translation of linear motion to rotary motion. Specifically, the energy translation mechanism includes a rotary joint assembly whereby the arm of the energy translation mechanism is slidably attached to the piston so as to absorb torque generated by the movement of the ring shaped body about the output shaft. The engine further includes an energy transforming member working in concert with a motion control torque reaction device for reducing the lemniscate motion of the piston caused by the movement of the energy translation mechanism. Specifically the joint connecting the wobbler arm to the piston is a combination of two sliding and rotating pin joints that allow freedom of movement of the wobbler arm in all planes of motion relative to the piston except one, the joint will allow 100% of the piston firing pressure force to be applied to the wobbler arm as a torque output. The engine further includes a port time control system having a shaft phaser whereby the phase of the pistons or the relative position of the air control valve within the central cavity of the engine may be adjusted so as to achieve maximum engine performance.

DETAILED DESCRIPTION OF THE INVENTION

Figure 1:
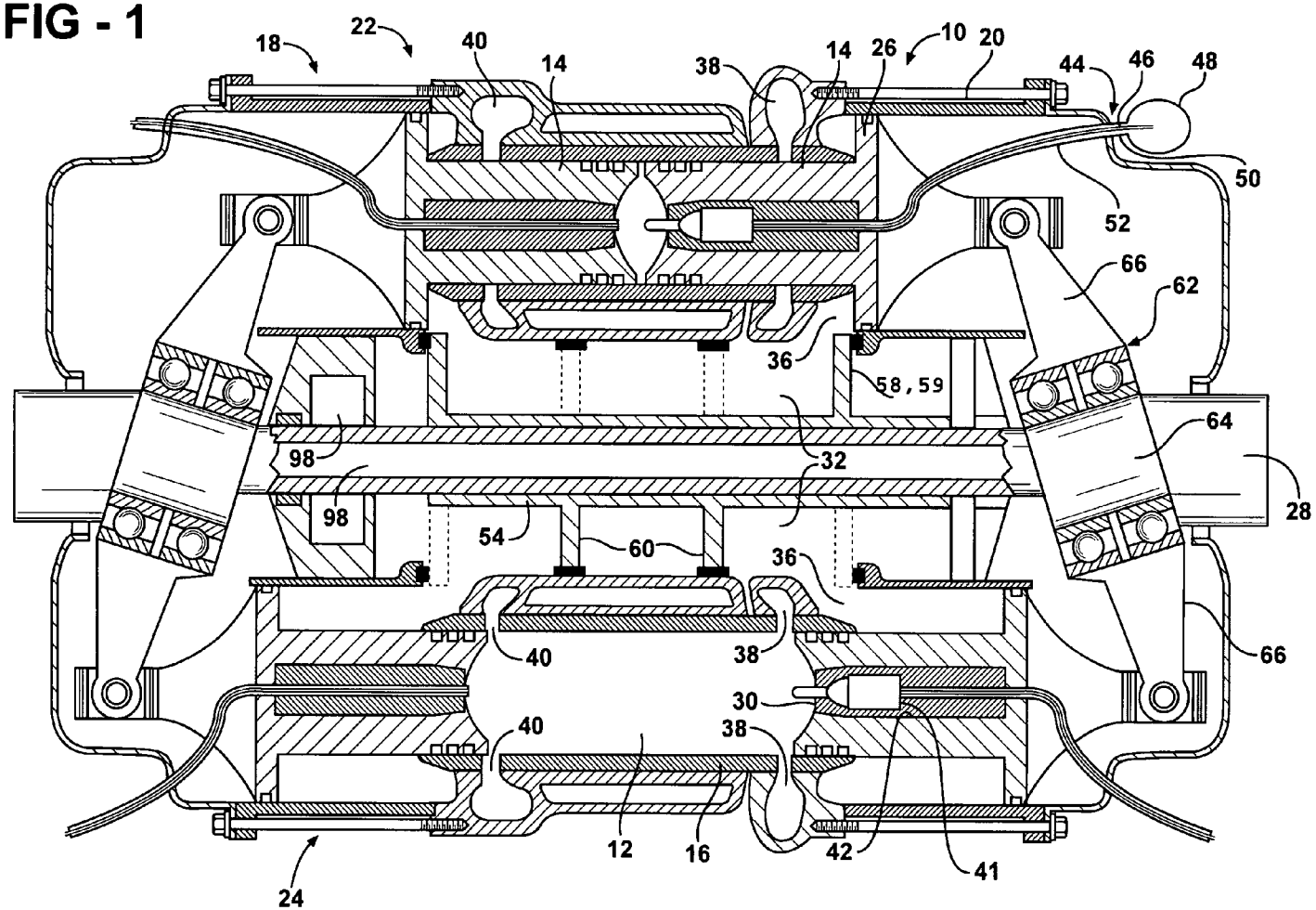
FIG. 1 is a cross-sectional view taken along the length of an engine of the preferred embodiment, though the engine is shown having two cylinders with opposing pistons, it is contemplated that the engine need only have one cylinder and one piston.
Figure 2:
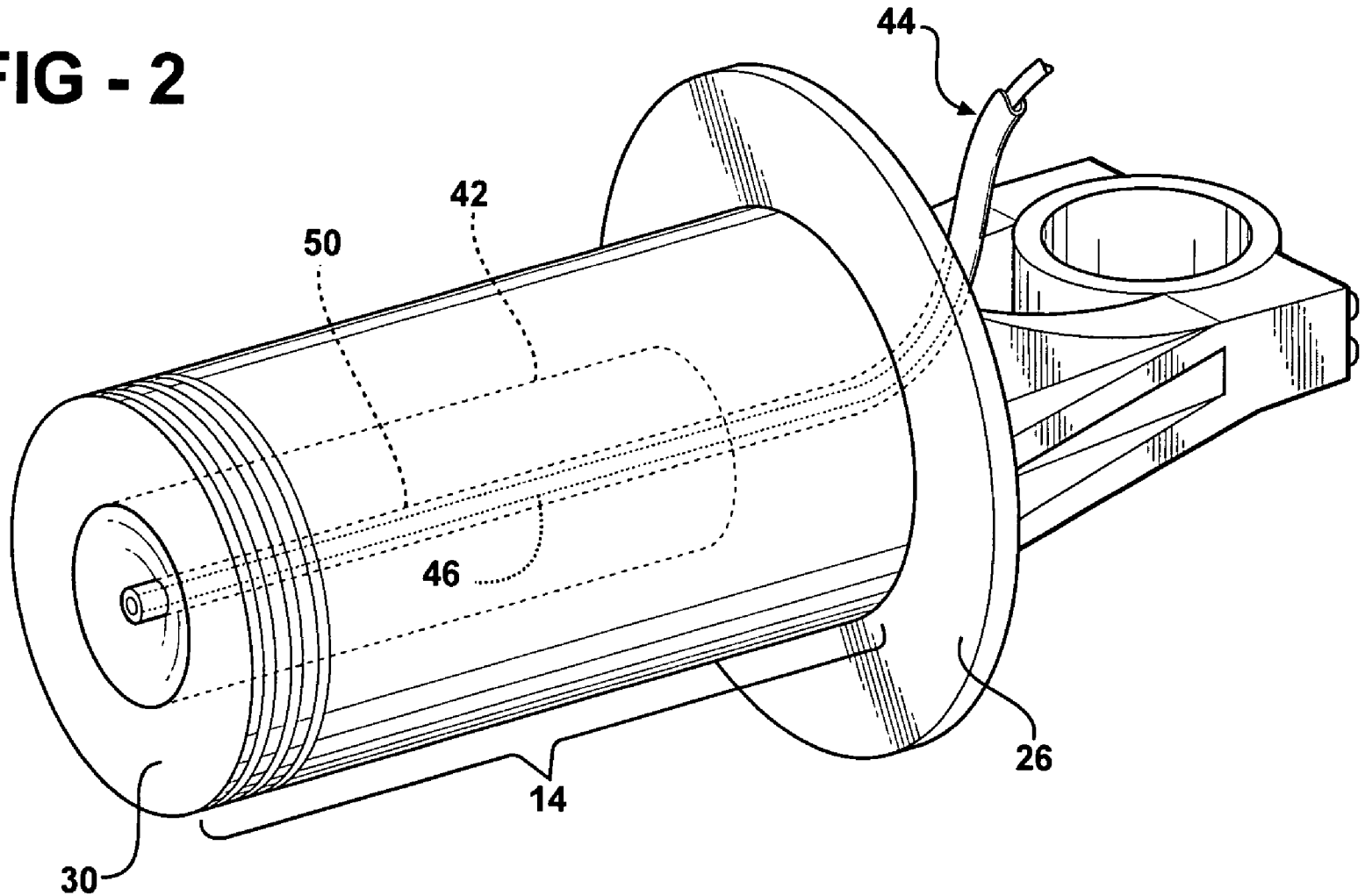
FIG. 2 is a first preferred embodiment of a piston having a fuel injector with a means for circulating coolant throughout the piston, the fuel injector is a standard and is not shown.

With reference to FIG. 1, an engine 10 having a means for providing compressed air into the combustion chamber 12, and a means for reducing power loss created by the created torque reacting normally between the piston 14 and the cylinder 16 is provided. The engine 10 also has a means for absorbing the torque reaction force from the piston 14, and a means to isolate the lemniscate motion of a translating device from the piston 14. For purposes of explanation, the engine 10 disclosed in the figures has two cylinders 16; however, this is description is to not to be read as a limitation on the number of cylinders 16 embodied by the engine 10 disclosed herein.

The engine 10 includes an engine block 18 housing at least one cylinder 16, wherein each cylinder 16 defines a combustion chamber 12 and includes a boost piston cylinder 20 integrally formed at each end. As shown in the FIG. 1, the combustion chamber 12 has a diameter lesser than the diameter of the boost piston cylinder 20. Thus as will be explained later in more detail, the volume of air within the boost piston cylinder 20 will be compressed and pushed into the combustion chamber 12 thereby providing more oxygen for the exothermic chemical process of combustion. The engine 10 includes at least one piston 14 movable between a compression stroke position 22 and a power stroke position 24. As defined herein the compression stroke position 22 refers to the position of the piston 14 when the piston 14 is displaced at its furthest point from the center of the combustion chamber 12, and the power stroke position 24 refers to the position of the piston 14 when the piston 14 is slidably moved to its furthest point within the combustion chamber 12. In the operation of the engine 10, the pistons 14, 26 will move from a compression stroke to a power stroke to complete one engine 10 cycle, each cycle produces rotary motion about the output shaft 28 which in turn provides the drive for equipment such as a vehicle.

In the first preferred embodiment, the engine 10 will include a pair of opposing pistons 14, slidably disposed within the combustion chamber 12 of the cylinder 16, however it is understood that it is not necessary to have a pair of opposing pistons 14 in order to remain within the scope and spirit of the claims presented herein. Each of the pistons 14, 26 has a piston head 30 which face one another within the combustion chamber 12. The piston head 30 of each pair of opposing pistons 14 comes towards each other when both of the opposing pistons 14 are slidably moved from a power stroke to a compression stroke. The pistons 14, 26 include a boost piston 26 integrally attached to the piston 14. As shown in FIG. 1, the boost piston 26 is spaced apart from the piston head 30 and is defined by an annular surface extending radially along the outer surface of the piston 14. The piston 14 and the boost piston 26 are fittingly received within The combustion chamber 12 and boost piston 26 chamber respectively. The boost piston 26 provides what is termed in the art as a supercharge because the annular surface area of the boost piston 26 is greater than the surface area of the piston head 30 a greater volume of external air is delivered to the combustion cylinder 16 than would possible by the piston head 30 alone; thus the engine 10 is supercharged.

The engine 10 includes a central cavity 32 and a plurality of ports 34, 36, 38, 40 for distributing air throughout the engine 10. For instance, the engine 10 includes at least one external intake port 34 for providing external air to the central cavity 32. A boost cylinder port 36 is disposed between a portion of the boost piston cylinder 20, whereby when the boost piston 26 is in the compression stroke position 22, the boost cylinder port 36 is closed off by the annular surface of the boost piston 26 and the boost cylinder port 36 is open when the boost cylinder 16 is in the power stroke position 24. In operation, external air is drawn into the boost piston cylinder 20 by the vacuum created in the boost piston cylinder 20 when the piston 14 moves from the compression stroke position 22 to the power stroke position 24. The engine 10 also includes an exhaust port 38 disposed in each combustion chamber 12, the exhaust port 38 allowing for the escape of expanding gases caused after the combustion process. Internal intake ports 40 are also provided. The internal intake ports 40 interconnect the central cavity 32 to each of the combustion chambers 12 thereby providing a means for compressed air to enter into the combustion chamber 12. The boost cylinder port 36 interconnects the boost piston cylinder 20 with the central cavity 32 so as to provide a means for the compressed air to pass from the boost piston cylinder 20 to the central cavity 32 where the compressed air then waits to be transferred to the combustion chamber 12 via the internal intake ports 40.

The engine 10 pistons 14, 26 are operable to rotate an output shaft 28. The output shaft 28 extends through the central cavity 32 of the engine block 18 and is generally parallel to the cylinders 16. In engines 10 having two or more cylinders 16, the output shaft 28 is generally centered between all of the cylinders 16 as shown in FIG. 1.

The engine 10 also includes a fuel injector assembly 42 disposed within at least one piston 14 within the combustion chamber 12. The fuel injector assembly 42 serves to cool the piston 14 and provide fuel to the combustion chamber 12 at an optimal position relative to piston 14 position. Specifically the fuel injector assembly 42 extends along the length of the piston 14 so as to deliver fuel directly into the combustion chamber 12, approximately orthogonal to the piston head 30.

Figure 5:
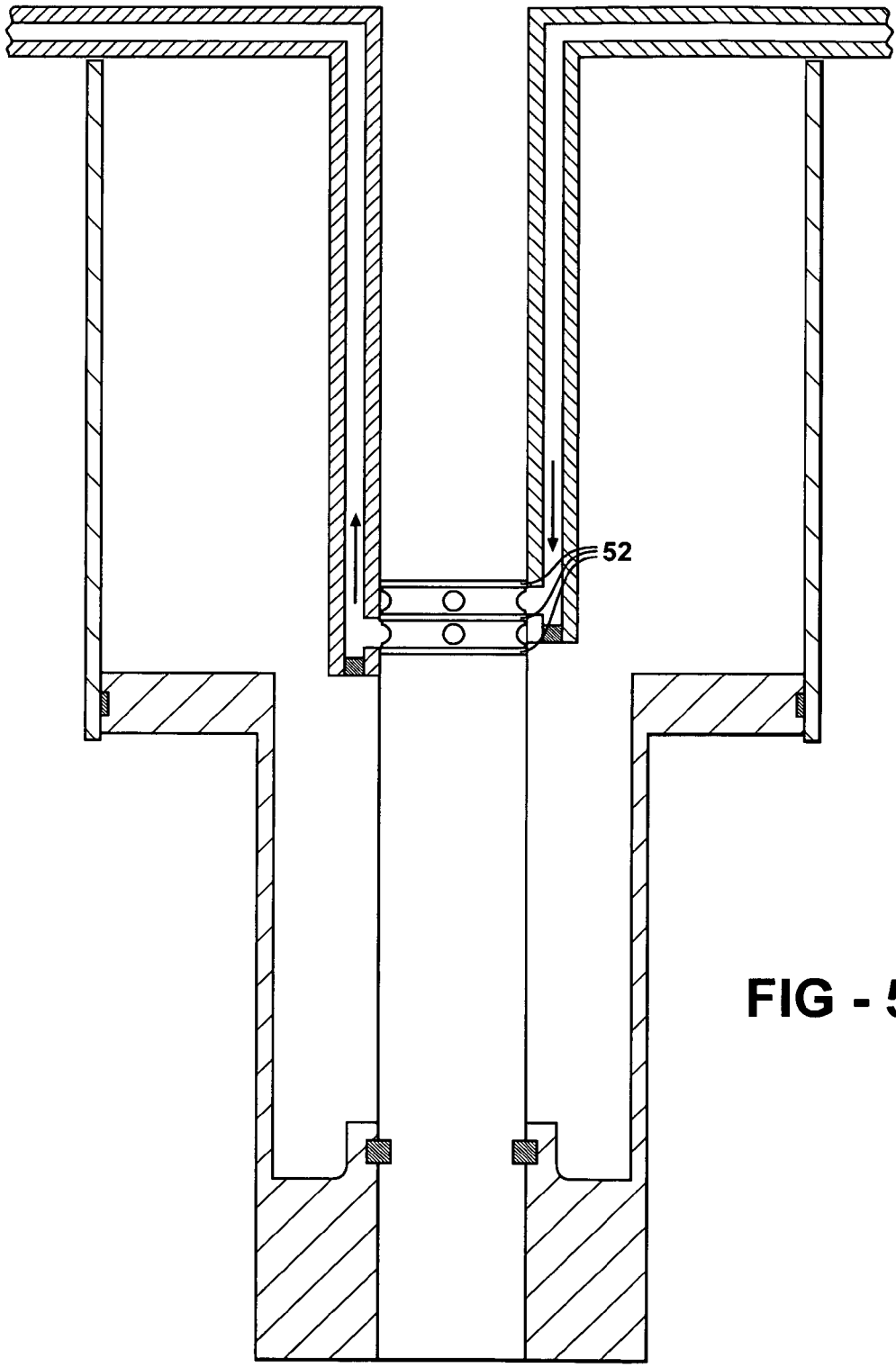
FIG. 5 is a cross-sectional view of the second preferred embodiment of a piston having a fuel injector and means for cooling the piston.

The fuel injector assembly 42 includes a standard fuel injector 41 coupled with a conduit 44 for circulating fuel within the piston 14 itself so as to help cool the piston 14 during operation thus allowing for maximum performance of the piston 14 during prolonged cyclic operation. In the first preferred embodiment, the fuel injector assembly 42 includes a first tube 46 extending along the length of the piston 14. The first tube 46 is connected to a pump 48 that feeds fuel through the first tube 46 directly into the combustion chamber 12. The pump 48 may be controlled by computer so as to control the amount of fuel pumped into the chamber as well as the timing at which the fuel is pumped. The first tube 46 is housed entirely within a second tube 50, the second tube 50 for allowing excess fuel to be circulated within the piston 14. A fluid control member 52 is disposed within both the first and second tube 46, 50. The fluid control member 52 may be a standard check valve or an arrangement of o-rings as shown in FIG. 5, whereby the movement of fuel is controlled. As shown in FIG. 5, the fluid control member 52 comprises three o-rings spaced apart from each other to define a high pressure area and low pressure area. A supply tube is interconnected to the high pressure area whereby the coolant/fuel is forced into the piston 14 body. An exiting tube extends from the low pressure area away from the piston 14, and can interconnect at the other end with the pump 48 or other container for storing fuel. Thus as the pump 48 feeds fuel into the high pressure area, pressure is increased within the piston 14 causing the excess fuel to exit through the low pressure area thus causing the fuel to circulate through the piston 14 and cooling it.

In operation, the fluid control member 52 will only allow fuel to exit the first tube 46, and prohibit circulated fuel in the second tube 50 from entering into the combustion chamber 12 so as to ensure that the pump 48 controls the fuel injection and thereby maximizing fuel injection. Thus the first tube 46, second tube 50, fluid control members 52 and the pump 48 work in concert to circulate fuel within the piston 14 and control fuel injection into the combustion chamber 12. It is also contemplated that the first and second tubes 46, 50 can be used just to cool the piston 14, by allowing a cooling medium such as ethylene glycol, oil, fuel or other cooling fluids to circulate therein by using the pump 48 and fluid control members 52.

Figure 3:
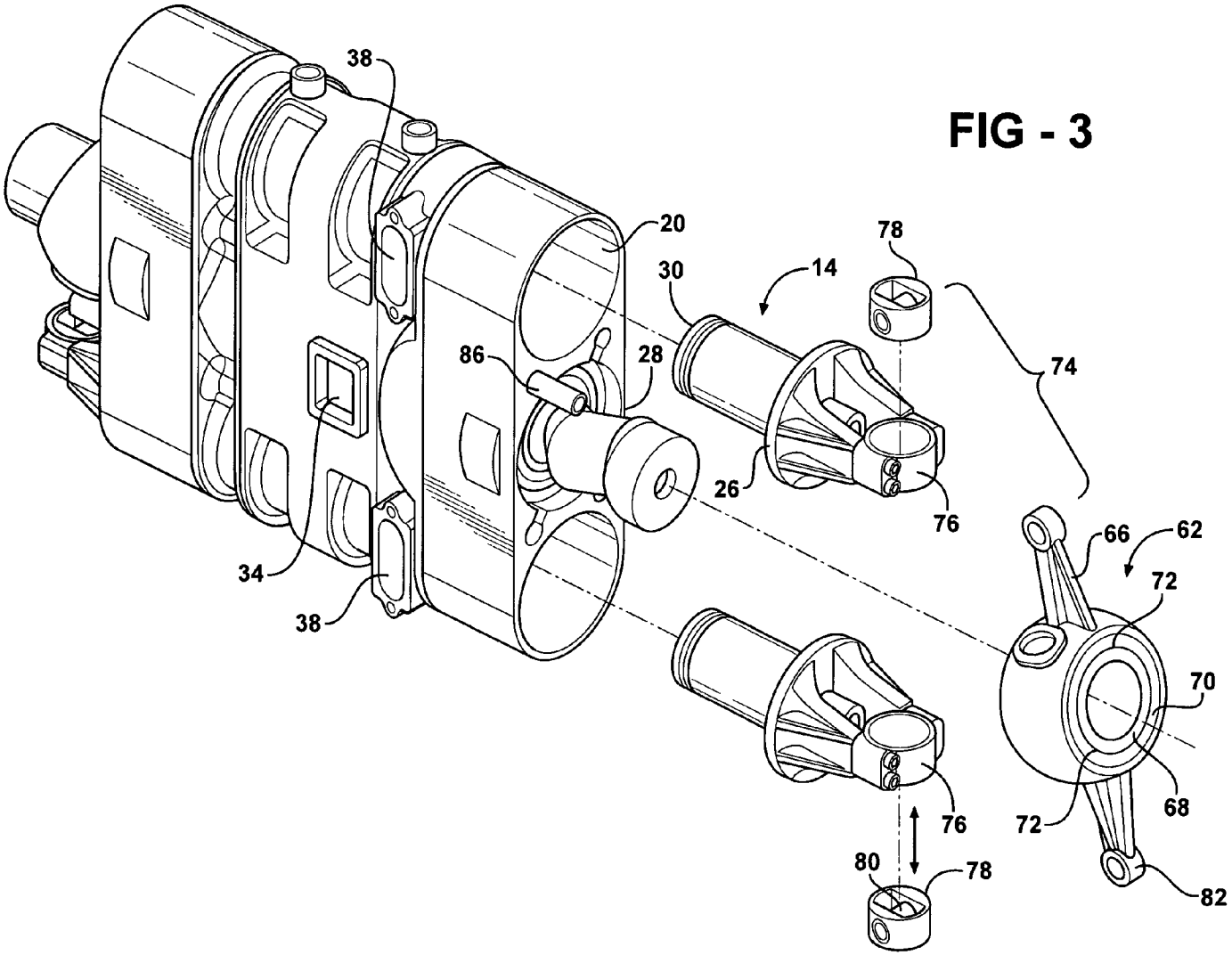
FIG. 3 is a partially exploded view of the energy translating device of FIG. 1.
Figure 4:
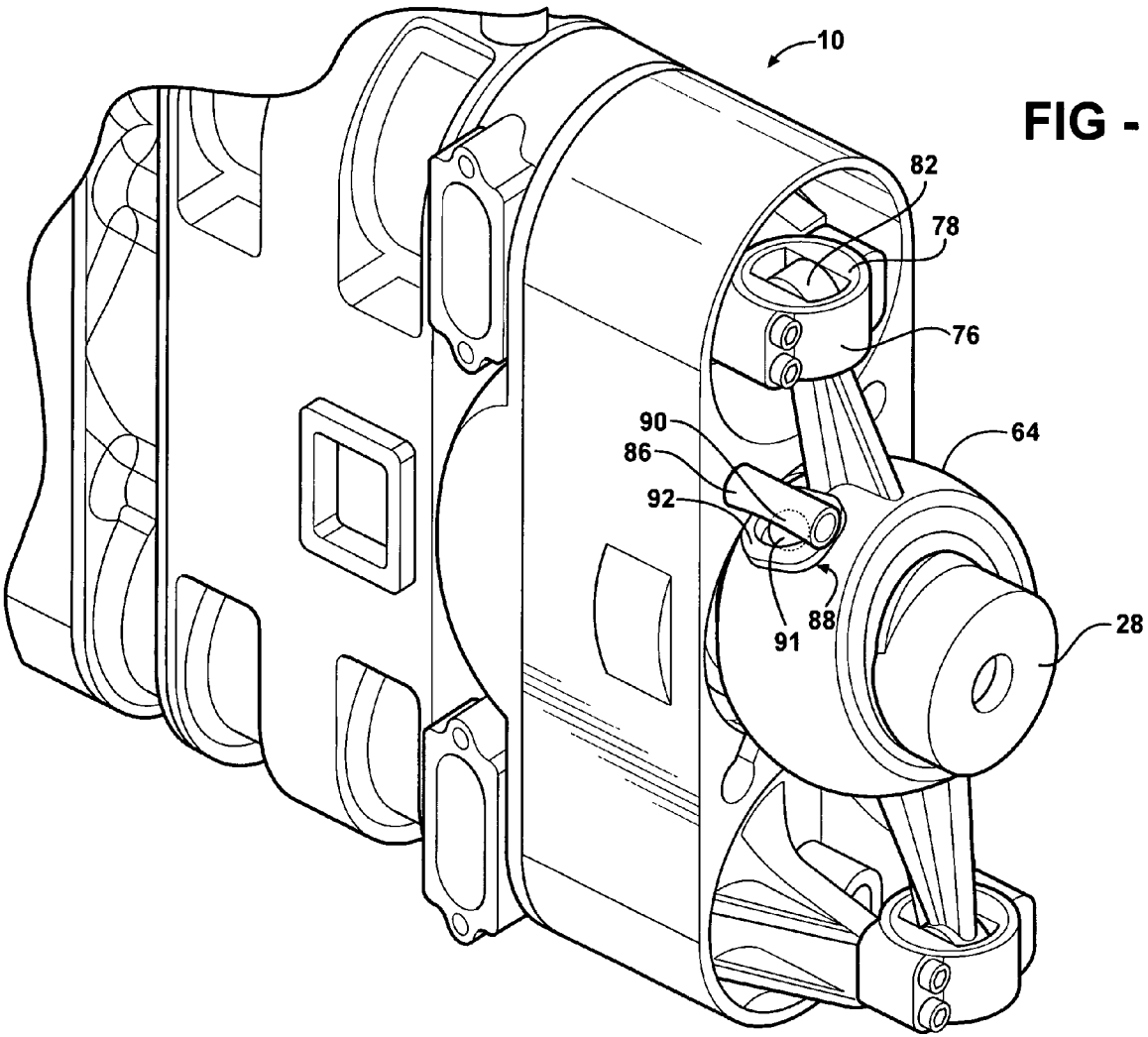
FIG. 4 is a perspective view of the engine of FIG. 1.
Figure 6:
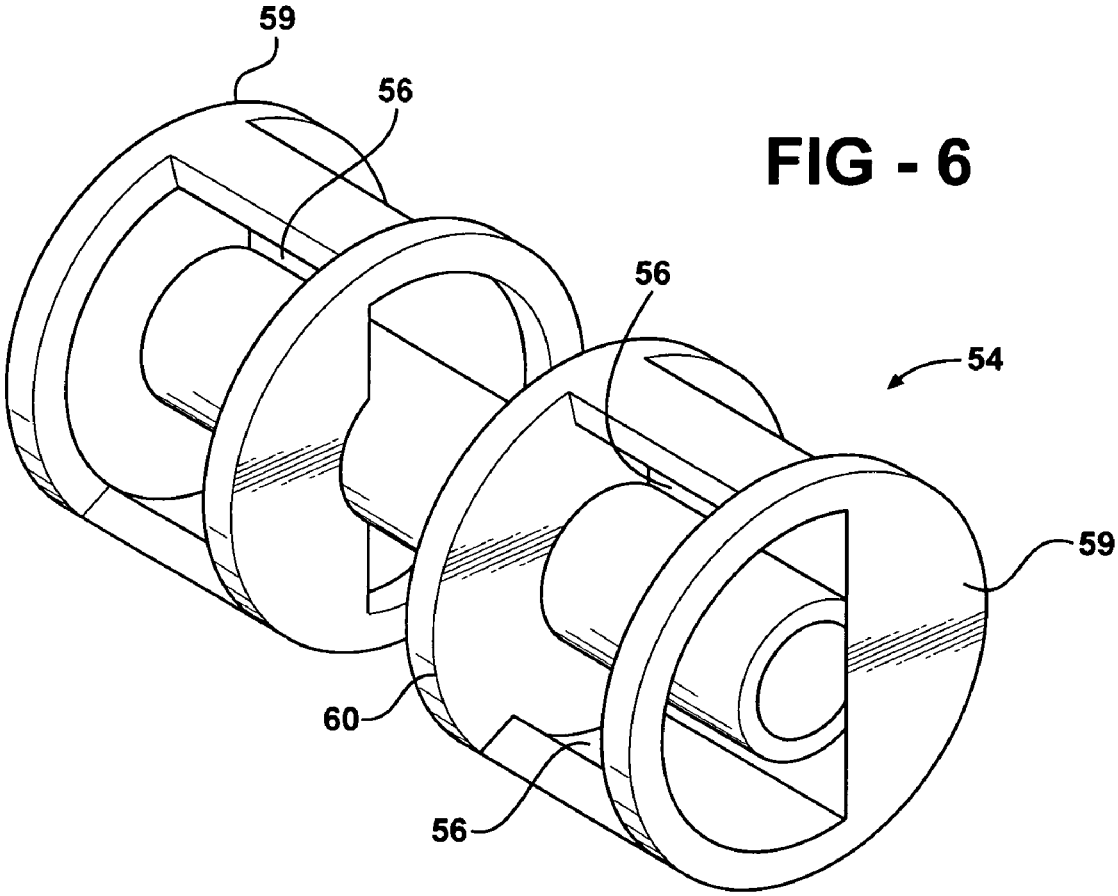
FIG. 6 is a perspective view of the first preferred embodiment of an air control valve.

With reference now to FIGS. 3 and 6, an air control valve 54 is shown. The air control valve 54 is disposed fittingly within the central cavity 32 of the engine 10. The air control valve 54 is fixedly secured to the output shaft 28 such that the rotation of the air control valve 54 is synchronized with the rotation of the output shaft 28. A cotter pin, set screw or other such fastening device may be used to secure the air control valve 54 to the output shaft 28, The air control valve 54 includes at least one wall 56 and at least two flanges 58 extending from the output shaft 28 to the inner surface of the central cavity 32 so as to partition the central cavity 32. Each partition is in synchronization with and rotating about the output shaft 28. The partitions are in communication with the internal intake ports 40 so that the partitions rotate about the output shaft 28 the one of the partitions in one position about the output shaft 28 is in communication with the boost cylinder port 36 and receives compressed air from the boost piston cylinder 20. The partition then continues to rotate about the output shaft 28 until it is in communication with the boost cylinder port 36 wherein the pressure of the compressed gas forces the compressed gas into the combustion chamber 12. Accordingly, the number of walls 56 and flanges 58 will vary depending upon the arrangement of the internal ports 34, 36, 38, 40, boost cylinder port 36 and the central cavity 32.

In the first preferred embodiment, the air control valve 54 includes pair of walls 56 extending along the length of the output shaft 28 and outwardly towards the inner surface of the central cavity 32 so as to partition the central cavity 32. The air control valve 54 further includes a pair of first flanges 60 wherein the first flanges 60 are spaced apart from each other so as to not obstruct the boost cylinder port 36. The first flanges 60 are generally parallel to the each other. The pair of first flanges 60 extends radially from the air control valve 54 to the inner surface of the central cavity 32. The air control valve 54 also includes a pair of second flanges 59 wherein the second flanges 59 are spaced apart from each other and registered with the opening of the boost cylinder port 36 when the air control valve 54 is rotated about a predetermined position within the central cavity 32. The first flanges 60 are generally parallel to the each other, thus when the air control valve 54 is rotated about the shaft, the second flanges 59 will register with the openings of each boost cylinder port 36 so as to receive compressed air from the boost cylinder 16 when the pistons 14, 26 move from a power stroke position 24 to a compression stroke position 22. The compressed air is then contained within the partition of the central cavity 32 defined by the second flanges 59 and the wall 56, and said partition rotates about the shaft in synchronization with the shaft rotation so as to be positioned to communicate with an internal intake port 40 where the compressed air is then forced into the combustion chamber 12. An additional enhancement for increase volumetric efficiency and power is to direct the compressed boost air to an inner cooler mechanism thus removing heat from compression and return the air to the air distribution rotary valve in a denser, cooler form. A second variation would have the air distribution rotary valve be made in two sections with the second delivery section connected to a partitioned separate intake port which can be closed later than the exhaust and yield asymmetric port timing.

The engine 10 further includes an energy translation mechanism 62 so as to translate the linear motion of the piston 14 into rotary motion of the output shaft 28. As shown in FIG. 1, the engine 10 is equipped with two cylinders 16 thus, a pair of energy translation mechanisms 62 is provided. The energy translation mechanism 62 is attaches the piston 14 to the output shaft 28. Specifically, the energy translation mechanism 62 includes a ring shaped body 64 fittingly mounted onto the output shaft 28, and an arm 66 for connecting the ring shaped body 64 to the piston 14. Accordingly, as the piston 14 moves from a compression stroke position 22 to a power stroke position 24, the piston 14 urges the arm 66 away from the engine block 18, which in turn forces a portion of the ring shaped body 64 against the output shaft 28 creating a torque force onto the output shaft 28 thereby turning the output shaft 28. The ring shaped body 64 includes an inner ring 68 fittingly engage with an outer ring 70. Ball bearings 72 are disposed between the inner ring 68 and the outer ring 70 so as to provide movement of the ring body against the output shaft 28.

The translation of linear movement into rotation creates a lot of friction, thus a rotary joint assembly 74 rotatably connecting the piston 14 to the arm 66 is included. The rotary joint assembly 74 includes a tubular shaped pin case 76, and a piston arm ring 78 slidably fitted within the pin case 76. The piston arm ring 78 has a slot so as to allow the arm 66 to rotate about the length of output shaft 28 with over twenty degrees of freedom. The pin case 76 is disposed on the free end of each piston 14, and the piston arm ring 78 supports a piston pin 80 extending across opposite sides of the piston arm ring 78. A guide ring 82 is integrally formed on the free end of the arm 66, the guide ring 82 is mounted onto the piston pin 80 so as to slidably engage the piston 14 ring and move between the opposite sides of the piston case 84 as the pistons 14, 26 move between a compression stroke position 22 and a power stroke position 24. During the cyclic operation of the pistons 14, 26, the arm 66 will travel along a lernmiscate path. Accordingly, it is desirable to a means for the arm 66 to travel along the lemniscate path without undue friction, as friction will cause power loss. Thus the rotary joint assembly 74 is provided. In operation, the guide ring 82 is able to slide along the piston pin 80, and is able to torque within the pin case 76 as the arm 66 is held within the piston arm ring 78, which is slidably fitted within the pin case 76. Furthermore, the piston arm ring 78 is able to move in and out of the pin case 76. Thus, the rotary joint assembly 74 allows the arm 66 of the energy translation mechanism 62 to torque freely inside the bearing housing assembly, thus permitting the arm 66 of the energy translation mechanism 62 to rotate relatively freely about the output shaft 28 and in harmony with the cyclic operation of the pistons 14, 26. Thus the engine 10 can have a stroke length to cylinder 16 bore ratio greater than that of prior art barrel engines. Thus the energy translation mechanism 62 reduces engine 10 friction while providing higher compression ratios at decreased combustion chamber 12, surface to volume ratios and heat loss, such that engine 10 power and efficiency is increased.

As discussed, the linear motion of the pistons 14, 26 acting on the parallel output shaft 28 causes the arm 66 of the energy translation mechanism 62 to move in a lemniscate motion and creates a torque reaction force on the pistons 14, 26. Furthermore, the addition of pistons 14, 26 and thus corresponding energy translation mechanism 62 arms 66 may cause the lemniscate motion of each of the arms 66 to be unequal as the arms 66 are moving about in different geometric planes. Accordingly, the engine block 18 includes an energy transforming member 86 working in concert with a motion control torque reaction device 88, in the preferred embodiment, the energy transforming member 86 is a long rigid shaft extending generally orthogonal to the engine block 18 and adjacent the ring shaped body 64 of the energy translation mechanism 62.

The energy transforming member 86 includes an aperture 90. The motion control torque reaction device 88 is disposed on a portion of the energy translation mechanism 62 and includes a rolling element 91 such ball bearing and a track 92. The rolling element 91 is fittingly disposed between the energy transforming member 86 and the track 92, with a portion of the bearing rotatably positioned within the aperture 90 of the energy transforming member 86. The track 92 defines a predetermined path of travel 94 and has an undulating surface for the ball bearing to roll upon, thus as the ring shaped body 64 is rotatably urged against the output shaft 28 by the movement of the pistons 14, 26, the arm 66 is subject to lemniscate motion which in turn is then isolated from the piston 14 through a siding pin interface with proper clearance to the piston 14 body. Accordingly, the lemniscate motion is to the movement of the ball bearing along the predetermined path of travel 94 thus equalizing the lemniscate motion of the energy translation mechanism 62 arm 66. Furthermore, the motion control torque reaction device 88 absorbs some of the torque reaction forces so as reduce the friction of the pistons 14, 26 against the inner wall 56 of the combustion chamber 12. Thus the energy transforming member 86 working in concert with a motion control torque reaction device 88 is provided so as to reduce power loss created by the torque reacting force normally created between the piston 14 and the cylinder 16, and absorb the torque reaction force from the piston 14, and a means to isolate the lemniscate motion of a translating device from the piston 14 is also provided.

A port time control system 96 is also included. The port time control system 96 for changing the position of the energy translation mechanism 62 so as to offset the position of one energy translation mechanism 62 to another in engines 10 equipped with a pair of energy translation mechanisms 62. The port time control system 96 includes a shaft phaser 98 and an electronic control unit 100 (ECU) or a suitable mechanical programmable device, (such as centrifugal weights in a distributor) not shown. The ECU receives engine 10 information such as the rotational speed of the output shaft 28, engine 10 load and the like to determine the most efficient phase for the piston 14. Meaning, during certain engine 10 conditions, it may be preferably when having opposing pistons 14, to have one piston 14 move from the compression stroke position 22 to the power stroke position 24 at different time than the opposing pistons 14. The ECU upon determining the optimal phase for the pistons 14, 26 operation then sends a signal to the shaft phaser 98, and the shaft phaser 98 rotates the energy translation mechanism 62 relative to the output shaft 28 thereby adjusting the piston 14 phase to achieve better engine 10 efficiency. The placement of the shaft phaser 98 can be at either end of the engine block 18. In opposing piston 14 engine 10 configurations the piston 14 adjacent the exhaust port 38 is referred to in the art as the exhaust piston 14, and also as the lead piston 14. The piston 14 adjacent the intake port is referred to in the art is the intake piston 14, and also as the lag piston 14. In order to achieve maximum engine 10 performance it is desirable to have the exhaust port 38 opening, lead the intake opening on the down stroke (meaning, the movement of the pistons 14, 26 from the compression stroke to the power stroke position 24). It is also desirable to have the exhaust port 38 close before the intake on the upstroke (meaning, the movement of the pistons 14, 26 from the power stroke to the compression stroke position 22) as this allows for better supercharging of the combustion chamber 12. This effect can be achieved by adjusting the motion of the intake and exhaust pistons 14, 26 relative to each other, referred to in the art as phasing. Thus, the opposing pistons 14 are not operating in a symmetrical fashion; rather they are operating asymmetrical to each other. A symmetrical phasing of the opposing pistons 14 can be achieved by offsetting the placement of the energy translation mechanism 62 of the intake piston 14 with respect to the energy translation mechanism 62 of the exhaust piston 14 such that the arms 66 of each energy translation mechanism 62 are not aligned with each other. Thus, as the arms 66 are not aligned with each other the motion of the pistons 14, 26 are subjected to different amounts of friction and thus one will lead the other. Accordingly, the exhaust port 38 can be opened early without automatically closing the intake port based upon engine 10 demand. In a second preferred embodiment, the air control valve 54 is rotatable about the output shaft 28, and the relationship of the air control valves 54 to the output shaft 28 may also be adjusted so as to regulate the distribution of compressed air within a partition of the central cavity 32 to combustion chamber 12, thus the timing of air intake can be automatically adjusted to further facilitate engine 10 efficiency. In a third preferred embodiment asymmetry is created by having two rows of intake ports 34, 40 or widening the dimensions of one part with respect to the other. The port closest to TDC will be blocked by the rotary valve during the beginning of the exhaust stroke and opened after the exhaust port 38 closes, thus creating asymmetry.

Thus the engine 10 described herein has a boost piston 26 and boost piston cylinder 20 housed within the engine block 18 so as to supercharge the engine 10 without the additional space required by the prior art. Furthermore, the engine 10 described herein includes an energy translation mechanism 62 with a rotary joint assembly 74 which provides the engine 10 with a greater stroke length to cylinder 16 bore ratio than engines 10 of the prior art. The energy transfer member in concert with the lemniscate motion translator and the energy translation mechanism 62 help reduce side friction of the pistons 14, 26 against the inner surface of the combustion chamber 12 and therefore further increases the energy efficiency of the engine 10. Finally, the engine 10 described is more adaptable to engine 10 load and conditions by having a means for phasing either the air control valve 54 or the cyclic operation of the pistons 14, 26 to maximize engine 10 performance. Asymmetry can also be obtained by use of dual rows of intake ports 34, 40 which are individually timed by two separate rotary air valve passages.

We claim:

1. An engine comprising:

an engine block housing a cylinder, the cylinder defining a combustion chamber and including a boost piston cylinder integrally formed at each end, and the boost piston cylinder having a greater volume than the combustion chamber;

a pair opposing pistons slidably disposed within the combustion chamber of the cylinder, each of the pair of opposing pistons slidable between a power stroke position and a compression stroke position to define a cycle of operation, each of said pair of opposing pistons having a piston head disposed within the combustion chamber of the cylinder wherein the piston head of one of the pair of opposing pistons faces the piston head of the other of the pair of opposing pistons, each of said pair of opposing pistons further including a boost piston spaced apart from the piston head and disposed within the boost piston cylinder, the boost piston integral to each of the pair of opposing pistons;

an external intake port for providing external air to the boost piston cylinder;

an exhaust port releasing combusted air from the combustion chamber to the environment;

a central cavity interconnected with the boost piston cylinder;

a boost cylinder port interconnects the boost piston cylinder with the central cavity so as to provide a means for the compressed air to pass from the boost piston cylinder to the central cavity;

at least one internal intake port interconnecting the central cavity to each of the combustion chambers, the internal intake port for providing the combustion chamber with compressed air;

an output shaft extending through the central cavity of the engine block and disposed between each of the at least one cylinder;

a fuel injector assembly disposed within at least one of the pair of pistons, the fuel injector assembly including a fuel injector attached to a conduit, the conduit includes a first tube extending along the length of the piston, the first tube for providing fuel to the combustion chamber, a second tube also extending along the length of the piston and housing the first tube, a fluid control member disposed in both the first and second tube, wherein the fluid control member disposed in the first tube only allows fuel to exit into the combustion chamber, and wherein the fluid control member disposed in the second tube only allows fuel to move away from the combustion chamber, the fuel injector assembly further including a pump, the pump interconnected with the first tube and pumping fuel through the first tube into the combustion chamber, the first tube, second tube, fluid control members and pump working in concert to circulate fuel within the piston;

an air control valve, the air control valve fixedly secured to the output shaft and disposed within the central cavity, the air control valve having at least one flange, the at least one flange extending radially from the air control valve to the wall of the central cavity separating the central cavity into partitions, the partitions separating compressed air from atmospheric air, the air control valve rotating within the central cavity in synchronization with the rotation of the output shaft, wherein when the boost pistons slidably move from a power stroke to a compression stroke, external air is provided to the boost piston cylinder by the external intake port, and the air is compressed by the boost piston, and one of the at least one flange rotated about the output shaft so as to be aligned to the opening of the boost cylinder port, wherein the compressed air from the boost piston cylinder is directed into the partition for holding compressed air via the boost cylinder port; and wherein as the output shaft rotates, the partition holding the compressed air within the central cavity is rotatably moved about the output shaft and registered to the internal intake port whereby the compressed air is further directed into the combustion chamber thereby providing low pressure to a defined portion of the central cavity;

a pair of energy translation mechanisms, one of the pair of energy translation mechanisms rotatably attached to one end of the output shaft, and the other of the pair of energy translation mechanisms rotatably attached to the other end of the output shaft, each of the pair of energy translation mechanisms including a ring shaped body fittingly enclosing a predetermined portion of the output shaft, the ring shaped body having an arm, the arm attached to each of the boost pistons, each of the pair of energy translation mechanisms including a rotary joint assembly interconnecting each piston to the energy translation member, the rotary joint assembly including a pin case disposed on the free end of each boost piston, the pin case supporting a piston pin, the piston pin extending transversely across the pin case, the rotary joint assembly further including a guide ring disposed on the free end of each arm of each energy translating mechanism, wherein when the pair of opposing pistons slidably move from the compression stroke to the power stroke, one of the pair of opposing piston pushes against the attached arm of the translating mechanism, the arm acting on the ring shaped body the ring shape body being angularly urged against a portion of the output shaft so as to apply a torque onto the output shaft thereby turning the output shaft, thus the translating mechanism translating the slidable movement of the pair of opposing pistons into rotary motion about the output shaft, and wherein when the pair of opposing pistons are operating in the cycle, the guide ring is slidably engaging the piston pin so as to help reduce the effect of the rotary motion of the output shaft on the cyclic operation of the pair of opposing pistons;

an energy transforming member attached to the engine block adjacent the output shaft, the energy transforming member being an elongated rigid member having an aperture;

a motion control torque reaction device including a ball or rolling element bearing and track or cam surface, the ball bearing disposed between the energy transforming member and the track of the motion control torque reaction device, wherein a portion of the ball bearing is fittingly engaged with the aperture of the energy transforming member, the track defining a predetermined path of travel for the ball bearing, wherein when the pair of opposing pistons complete a cycle of operation, the ball bearing is rotatably positioned underneath the aperture and travels along the predetermined path thereby absorbing rotary motion from energy transforming member so as to reduce side friction of the pistons within combustion chamber; and a port time control system having a shaft phaser controllable by an electronic or mechanical control unit, the shaft phaser disposed on the output shaft and rotatably engaging the energy translation mechanism, wherein the electronic control unit commanding the shaft phaser to rotate the energy translation mechanism so as to offset the position of one of the pair of energy translating mechanisms relative to the other of the pair of energy translating mechanisms.

* * * * *